United States Patent [19]

Caille

[11] 4,346,816

[45] Aug. 31, 1982

[54] PLASTIC END COVER FOR DRUMS

[75] Inventor: Gilles E. A. Caille, Paris, France

[73] Assignee: Expandet, Paris, France

[21] Appl. No.: 220,066

[22] PCT Filed: Mar. 25, 1980

[86] PCT No.: PCT/FR80/00044

§ 371 Date: Dec. 9, 1980

§ 102(e) Date: Dec. 9, 1980

[87] PCT Pub. No.: WO80/02273

PCT Pub. Date: Oct. 30, 1980

[30] Foreign Application Priority Data

Apr. 24, 1979 [FR] France ..... 79 10314

[51] Int. Cl.[3] ..... B65D 41/16; B65D 41/18

[52] U.S. Cl. ..... 220/306; 220/DIG. 19

[58] Field of Search ..... 220/306, DIG. 19; 229/43, 1.5 B; 150/0.5

[56] References Cited

U.S. PATENT DOCUMENTS

| | | | |
|---|---|---|---|
| 2,922,563 | 1/1960 | Aldington | 229/43 |
| 3,504,823 | 4/1970 | Logomasini | 220/306 |
| 3,946,897 | 3/1976 | Wolff | 220/306 |
| 4,026,459 | 5/1977 | Blanchard | 220/306 X |
| 4,275,815 | 6/1981 | Davis | 220/306 X |

FOREIGN PATENT DOCUMENTS

| | | |
|---|---|---|
| 1008009 | 2/1952 | France . |
| 1209641 | 9/1959 | France . |

*Primary Examiner*—George F. Hall

*Attorney, Agent, or Firm*—Spencer & Kaye

[57] ABSTRACT

An end cover for covering and protecting a drum having an upper tray with a circumferential lip. The end cover includes a circular top provided with an outer circumferential edge. The diameter of the top corresponds to the diameter of the drum to be covered and has an axis of symmetry perpendicular to the plane of the top. The end cover also includes a peripheral member comprising a convergent linear wall integral with the outer edge of the top, a divergent linear wall joined to the convergent linear wall and forming a circumferential V-shaped groove opening toward the exterior of the walls, and flat ribs spaced from one another around the V-shaped groove, each of the ribs being disposed in a vertical radial plane passing through the axis of symmetry, protruding from and being integral with the walls on either side of the apex of the V-shaped groove formed by the walls, and being positioned within the V-shaped groove to add rigidity to the walls and for preventing the walls from spreading apart. The peripheral member is forcefully deformed when the end cover is placed on the lip of the drum thereby assuring that the end cover remains fixed on the drum to seal the upper tray of the drum against intrusion of outside agents.

1 Claim, 5 Drawing Figures

PLASTIC END COVER FOR DRUMS

BACKGROUND OF THE INVENTION

The utilization of drums of all kinds is well known, whether it is a question of storing, or transporting solid or liquid products.

In all cases, and regardless of the dimensions of the different models, the drum is composed of a body which is generally cylindrical and often fluted, a bottom which is often convex and a top that is generally flat.

These different parts are assembled in such a way that the drum may be, in principle, hermetically sealed, the openings usually being located on the upper flat plate, in the form of, for example, two screw bungs with a threaded plug.

However, the part called the "upper flat" is in fact assembled in a recess with respect to the cylindrical walls of the drum, and thus constitutes a sort of upper tray, or depression, more or less deep, depending on the types of drums.

The drums are often made of metal and are used to store products such as lubricants. When the drums are stored outside, or are temporarily exposed to bad weather, or even during transport, thus upper tray, or depression, constitutes a reservoir for rainwater. Without any device for keeping it from so collecting, the water may, after a period of time, penetrate and infiltrate the metallic drum, with the risk of alterating the quality of the products, the lubricants for example, which are therein stored.

There is thus a technical risk for the manufacturer who stores and delivers his products in metallic drums of having to face complaints from his customers in the event such alteration by infiltration occurs, or that it might have occurred at any moment whatsoever before the drums containing the products were delivered to the customers.

SUMMARY OF THE INVENTION

The object of the present invention is to remedy the above-mentioned disadvantages and to assure a reinforced and complete protection of the products stored in drums. It alludes in particular to a device capable of covering the upper part of the drum hermetically by means of a clippable end cover, preferably made of a plastic material, in such a way that for its fitting and removal this end cover does not require any supplementary device, such as metallic bandings, or the like, and that, even when exposed to bad weather, water cannot penetrate between the end cover and the metallic part of the drum, and even less remain inside.

Thus, essentially, the object of this invention is to provide an end cover of synthetic resin whose diameter corresponds to the diameter of the drum to be covered and protected. The periphery of this end cover presenting, coming from the mold, a special extrusion with a swaged part that requires a forceful deformation to place the end cover on the lip of the drum, and simultaneously to assure that the end cover remains tightly in place to seal against the intrusion of outside agents.

Thermosetting, according to a well-known technique, of a sheet of high density, low pressure polyethylene, hereafter called PeHdBp, can constitute a method of making of this end cover. In this case, a negative metallic mold, presenting an undercut form is utilized, and the different shrinkages, primary (immediate) and secondary (with time), of the PeHdBp allow the unmolding of the end cover and assure its automatic clipping on the drum.

In accordance with a particularly advantageous embodiment of this invention, the extruded section of the swaged part includes regularly spaced rigidity ribs around the periphery of the end over for obtaining a more efficient tightness of the end over on its support. This is also due to a better elasticity of the extrusion.

BRIEF DESCRIPTION OF THE DRAWINGS

Other particularities and advantages will appear from the reading of the description and the claims which follow, with reference to the accompanying drawings on which:

DESCRIPTION OF THE PREFERRED EMBODIMENTS

Referring to the Figures jointly, a drum 1 has an upper flat or tray 1*a* which has a lip 1*b*. An end cover 2 has a circular top 2*a* integrally connected with a peripheral member 3 comprising a convergent linear wall 3*a* joined to a divergent linear wall 3*b* to form a V-shaped groove 3*c*.

Figure 1:
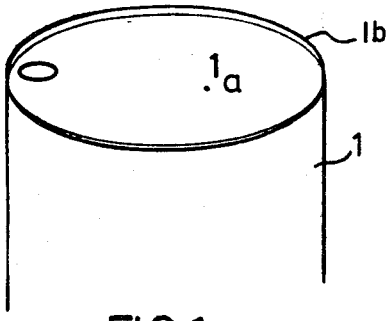
FIG. 1 is a view in partial perspective, from above, of a metallic type drum, for example, intended for storing and transporting lubricants.
Figure 2:
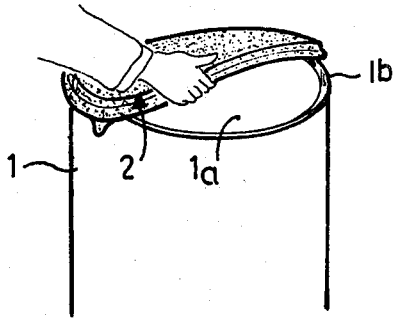
FIG. 2 shows the end cover being set in place by peripheral clipping.
Figure 3:
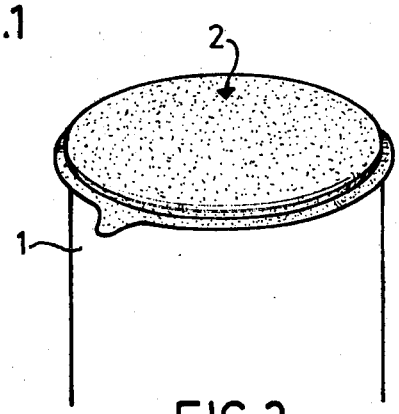
FIG. 3 represents the end cover clipped on the drum.
Figure 4:
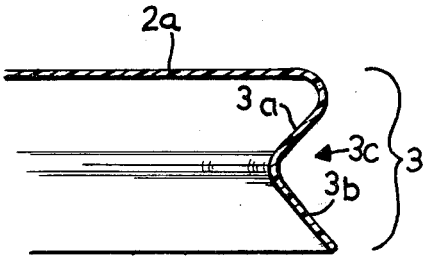
FIG. 4 represents a cross-section of an end cover, showing the swaging of the periphery, obtained by molding. In this case, the swaging does not carry any rigidity notches.
Figure 5:
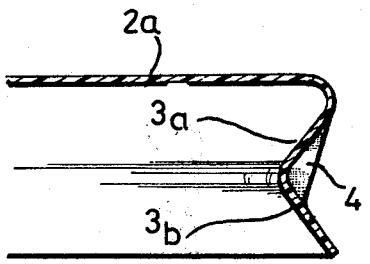
FIG. 5 is a view analogous to FIG. 4, but in this case the end cover includes the rigidity, or stiffening ribs, or notches, facilitating the placing—removal of the end cover, as well as the tightness on the top of the drum to be protected.

A pluraity of flat ribs 4, one of which is depicted in FIG. 5, are spaced, one from another around V-shaped groove 3*c* in vertical radial planes passing through the axial line of symmetry of top 2*a*. As can be seen from FIG. 5, flat ribs 4 protrude from and are integral with walls 3*a* and 3*b* on either side of the apex of V-shaped groove 3*c*. Being so positioned in V-shaped groove 3*c*, ribs 4 prevent walls 3*a* and 3*b* from spreading apart. In order to place end cover 2 on lip 1*a* of drum 1, peripheral member 3 must be forcefully deformed which simultaneously assures that end cover 2 will remain fixed on the drum to seal upper tray 1*a* against intrusion of outside agents.

The examination of the figures concerning the end cover and its process for fitting by clipping should render the invention and its manner of use perfectly understandable.

The clipping works, not only thanks to the undercut and the shrinkage of the Pe Hd Bp, but also thanks to all the ribs 4 arranged at the level of the said undercut.

Ribs 4 may be more or less numerous, and arranged on a part of, or on all of peripheral member 3 of end cover 2. Ribs 4 when combined with the undercut, and calculated precisely for the primary and secondary shrinkages of the plastic material, assure an automatic clipping of end cover 2 on the upper part of drum 1, without any supplementary device being necessary, neither for the fitting, nor for the tightening, nor for the removal of end cover 2.

This presents obvious advantages with respect to maintenance costs.

Naturally, other embodiments can be envisioned, notably the thermosetting of other types of plastic materials, either in natural color, or in different colors, or again by injection molding of said end covers in undercut, without these examples being either exclusive or limitating.

It will easily be understood, that the presence of notches, or ribs, will assure a great ease in handling during fitting or removal of the end cover, and make possible an efficient tightening on the metallic drum, while at the same time giving a possibility of adaptation to some variations or tolerances in diameter for a type of metallic drum under consideration.

The function of this end cover is not the closing of the metallic drum which is already effected by a metallic recess previously called the upper tray. Rather the purpose is the protection of the drum against bad weather, and notably against the deposit and infiltration of rainwater.

By utilizing a high shrink plastic, such as high density, low pressure polyethylene, and by working at a well determined temperature range, taking into account the extrusion direction of the sheets or plates utilized, it is possible to obtain an optimum shrinkage at the undercut level, and assure a satisfying tightening of the end cover on the drum.

Finally, it will be noted that the utilization of a plastic material having translucent qualities will permit a correct reading of the references imprinted on the upper part of the metallic drum. Alternatively, the use of an opaque plastic material in different colors would permit, if necessary, a rapid identification, according to the color of the end cover, of the products stored in the metallic drums.

I claim:

1. An end cover for covering and protecting a drum having an upper tray with a circumferential lip, comprising:

a circular top provided with an outer circumferential edge, said top having a diameter corresponding to the diameter of the drum to be covered and having an axis of symmetry perpendicular to the plane of said top; and a peripheral member comprising:

a convergent linear wall integral with said outer edge of said top;

a divergent linear wall joined to said convergent linear wall and forming a circumferential V-shaped groove opening toward the exterior of said walls; and flat ribs spaced from one another around said V-shaped groove, each of said ribs being disposed in a vertical radial plane passing through said axis of symmetry, protruding from and being integral with said walls on either side of the apex of said V-shaped groove formed by said walls, and being positioned within said V-shaped groove to add rigidity to said walls and for preventing said walls from spreading apart, whereby said peripheral member is forcefully deformed when said end cover is placed on the lip of the drum thereby assuring that said end cover remains fixed on the drum to seal the upper tray of the drum against intrusion of outside agents.

* * * * *